United States Patent [19]

Tanabe

[11] Patent Number: 4,788,536

[45] Date of Patent: Nov. 29, 1988

[54] METHOD OF DISPLAYING COLOR PICTURE IMAGE AND APPARATUS THEREFOR

[75] Inventor: Kanji Tanabe, Hadano, Japan

[73] Assignee: Hitachi, Ltd., Tokyo, Japan

[21] Appl. No.: 767,045

[22] Filed: Aug. 19, 1985

[30] Foreign Application Priority Data

Sep. 26, 1984 [JP] Japan ..... 59-201302

[51] Int. Cl.[4] ..... G09G 1/16

[52] U.S. Cl. ..... 340/703; 340/747

[58] Field of Search ..... 340/703, 747, 709, 750, 340/798, 801

[56] References Cited

U.S. PATENT DOCUMENTS

| | | | |
|---|---|---|---|
| 4,367,533 | 1/1983 | Wiener | 340/731 |
| 4,495,491 | 1/1985 | Postl | 340/709 |
| 4,509,043 | 4/1985 | Mossaides | 340/703 |

*Primary Examiner*—Marshall M. Curtis

*Attorney, Agent, or Firm*—Antonelli, Terry & Wands

[57] ABSTRACT

Disclosed are a method of displaying a color picture image and an apparatus therefor, in which there are provided a first memory into which a code of graphic display to be displayed on a picture screen is stored at a position corresponding to a display position of the code on the picture screen and from which the stored code is read out in synchronism with raster scanning on the picture screen; a second memory into which color display dot pattern data of N bits per color picture element on the picture screen are stored; and a circuit in which color display signals R, G and B are formed on the basis of output data produced from the first memory and transferred to a picture screen display means; in which reading-out control of the first and second memories in the case of color display is performed in the same manner as in the case of monochromatic display; in which the display color of each color picture element constituted by N bits on the picture screen is designated by N bits of the color display dot pattern data; and in which the color picture image is displayed by using the same memory capacity as that in the case of monochromatic display.

8 Claims, 4 Drawing Sheets

FIG. 2a

31

| | | | | |
|---|---|---|---|---|
| 001 | 002 | 003 | 004 | ... |
| 011 | 012 | 013 | 014 | ... |
| 021 | 022 | ..... | | |
| 031 | 032 | ..... | | |

FIG. 2b

32

| | | | | |
|---|---|---|---|---|
| 001' | 002' | 003' | 004' | ... |
| 011' | 012' | 013' | 014' | ... |
| 021' | 022' | ..... | | |
| 031' | 032' | ..... | | |

FIG. 3a

41

| | | | | |
|---|---|---|---|---|
| 001(R) | 002(B) | 013(G) | 014(B) | ... |
| 003(G) | 004(B) | 011(R) | 012(B) | ... |
| 101(R) | 102(B) | ..... | | |
| 103(G) | 104(B) | ..... | | |

42

FIG. 3b

43

| | | | | |
|---|---|---|---|---|
| 001'(R) 002'(B) | 001'(R) 002'(B) | 013'(G) 014'(B) | 013'(G) 014'(B) | ... |
| 003'(G) 004'(B) | 003'(G) 004'(B) | 011'(R) 012'(B) | 011'(R) 012'(B) | ... |
| 101'(R) 102'(B) | 101'(R) 102'(B) | ..... | | |
| 103'(G) 104'(B) | 103'(G) 104'(B) | ..... | | |

44

METHOD OF DISPLAYING COLOR PICTURE IMAGE AND APPARATUS THEREFOR

BACKGROUND OF THE INVENTION

The present invention relates to a method of displaying a color picture image and an apparatus therefor, in which a picture image is displayed on a picture screen by scanning rasters.

In the case where it is intended to display a color picture image in a CRT display device or the like in the same manner as in the case of a monochromatic picture image, there is a problem that the memory capacity increases in comparison with the case of display of monochromatic picture images because display memories are required corresponding to the respective colors.

As an example of prior art in which increase in memory capacity is avoided, a method disclosed in Japanese Patent Unexamined Publication No. 23519/1980 is known. In this method, a memory having the same number of bits as that of dots (the number of picture elements of a monochromatic picture image) on one picture screen is divided into four sections and the three color picture image information components R (red), G (green), and B (blue) are respectively written into the areas of the three of the four memory sections. The information components R, G, and B relatively in the same addresses counted from the respective head addresses are simultaneously read out from the divisional memory sections, and a set of read-out information components R, G and B are displayed at four dots constituting a corresponding color picture element on the picture screen of the CRT display device. Thus, although resolution is deteriorated, a color picture image can be displayed by using a memory with a capacity for one picture scene of a monochromatic picture image.

In such a method, however, there are such problems that it is impossible to use a highly densely integrated memory because the memory is divided into a plurality of memory sections, and that the logic controlling the memory reading-out operation is complicated because information components relatively in the same addresses counted from the respective head addresses are simultaneously read out from the divisional memory sections.

SUMMARY OF THE INVENTION

An object of the present invention is to provide a method of displaying a color picture image and an apparatus therefor, in which a color picture image is displayed by using a memory of the same capacity as that in the case of monochromatic display, without dividing the memory.

Another object of the present invention is to provide a method of displaying a color picture image and an apparatus therefor, in which a memory is not divided and in which the same memory reading-out control is performed both in the case of color display and in the case of monochromatic display, so as to simplify the peripheral logic of the memory.

A further object of the present invention is to provide a method of displaying a color picture image and an apparatus therefor, in which it is possible to use a highly densely integrated memory in a display device having a picture screen constituted by numbers of picture elements.

A still further object of the present invention is to provide a method of displaying a color picture image and an apparatus therefor, which has a simple arrangement, and in which flickers can be prevented from occurring on the picture screen.

To attain the objects as described above, in the method of displaying a color picture image and an apparatus therefor according to the present invention, there are provided a first memory in which codes of graphic display to be displayed on the picture screen are stored at positions corresponding to display positions on the picture screen and from which the stored codes are read out in synchronism with raster scanning on the picture screen; a second memory in which color display dot pattern data of N bits per color picture element on the picture screen are stored; and a circuit in which color display signals R, G and B are formed on the basis of output data from the first memory and transferred to a picture display means; in which control of reading-out of the first and second memories is performed in the same manner both in the case of color display and in the case of monochromatic display, judgement is made as to whether the read-out data is for color display or for monochromatic display on the basis of a character attribute, and the display color of each color picture element constituted by N dots on the picture screen is designated by N bits of a color display dot pattern data so that a color picture image is displayed.

Further, according to the present invention, the color display is controlled such that the display color of a color picture element on an even raster is different from that on an odd raster so as to prevent flickers from occurring on the picture screen.

The above and other objects, features, and advantages of the present invention will be apparent from the following detailed description taken in conjunction with the accompanying drawings.

BRIEF DESCRIPTION OF THE DRAWINGS

FIGS. 2*a* and 2*b* are explanatory diagrams for explaining the relationship between dot pattern data and picture screen display thereof in the case of monochromatic display;

FIGS. 3*a* and 3*b* are explanatory diagrams for explaining the relationship between dot pattern data and picture screen display thereof in the case of color display;

DESCRIPTION OF THE PREFERRED EMBODIMENT

Figure 1:
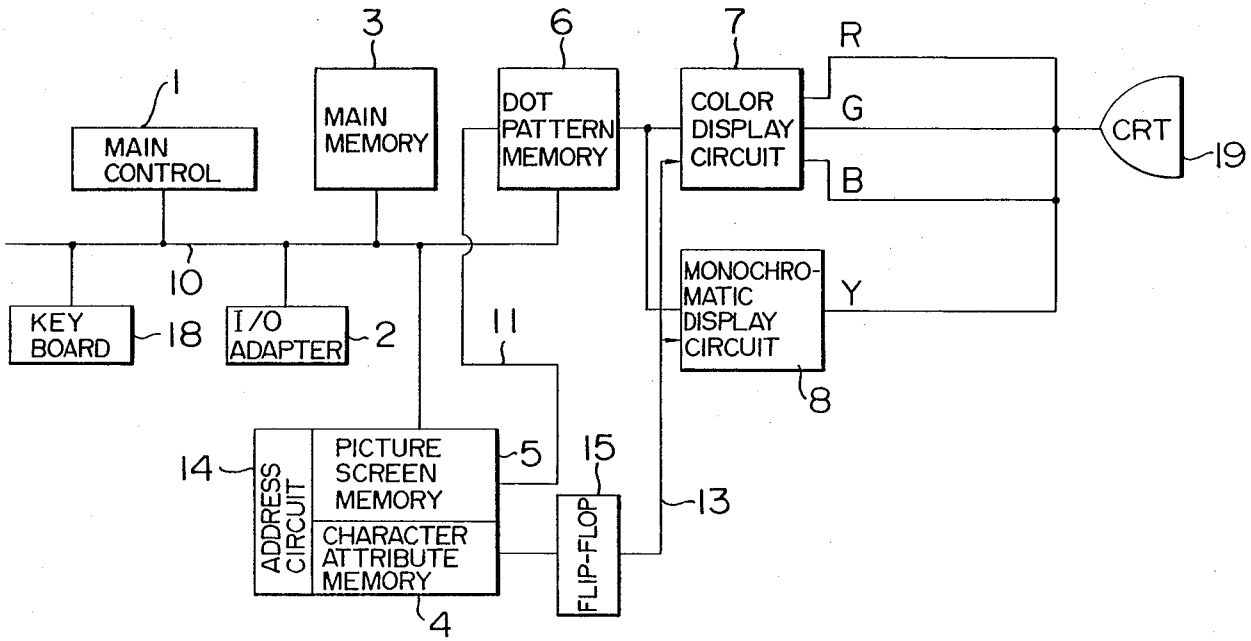
FIG. 1 is a block diagram showing the whole arrangement of an embodiment of the display apparatus according to the present invention.

Referring to the drawings, an embodiment according to the present invention will be described in detail hereunder.

FIG. 1 is a block diagram showing the embodiment of the display apparatus according to the present invention. In FIG. 1, a main control section 1 is constituted by a microprocessor, etc., for controlling the whole display apparatus. An I/O adaptor 2 is arranged such that a program of the main control section 1 is loaded therethrough, and a main memory 3 stores the program and the like.

A dot pattern memory 6 stores dot pattern data used for monochromatic or color display, and a picture screen memory 5 stores codes of display characters and produces an output signal 11 to be applied to the dot pattern memory 6 as a part of an address signal. A character attribute memory 4 is provided for storing character attributes constituting attribute data of the display characters. A specific bit of each of the character attributes stored in the character attribute memory 4 is used for control of change-over between monochromatic display and color display. The character attribute memory 4 corresponds to the picture screen memory 5 such that, for example, every two bytes of the character code in the picture screen memory 5 correspond to every one byte of the character attribute in the character attribute memory 4. An address circuit 14 produces an address signal for reading out the display character code from the picture screen memory 5. The main control section 1, the I/O adaptor 2, the main memory 3, the dot pattern memory 6, the picture screen memory 5, the character attribute memory 4, the address circuit 14, and a keyboard 18 are connected to each other through a bus 10. The data writing operation into the dot pattern memory 6, the picture screen memory 5, and the character attribute memory 4 is performed through the bus 10 under the control of the main control section 1, in response, for example, to the data entered by the keyboard 18.

A color display circuit 7 produces a red information signal (R), a green information signal (G), and a blue information signal (B) for color display, to a CRT 19 in response to a dot signal entered from the dot pattern memory 6. A monochromatic display circuit 8 produces a dot signal for monochromatic display to the CRT 19 in response to a dot signal entered from the dot pattern memory 6. The color and monochromatic display circuits 7 and 8 will be described later. A flip-flop 15 has its state controlled in accordance with a signal of a specific bit of the character attribute read out from the character attribute memory 4 in synchronism with reading-out of the display character code from the picture screen memory 5. An output signal 13 from the flip-flop 15 is applied to the color or monochromatic display circuit 7 or 8 as a color/monochrome change-over signal.

Signals of bits other than the specific bit of the character attribute are applied to the color and monochromatic display circuits 7 and 8 for luminance/blink control, however, the control is not related to the subject of the present invention and the explanation thereof is omitted.

First, description will be made as to the operation in the case of monochromatic display. When information for indicating an attribute to be added to the displaying data entered through the keyboard 18 is indicated, the data is stored in the picture screen memory 5 under the control of the main control section 1 on the basis of a program stored in the main memory 3, and, at the same time, the attribute indication information is stored in the character attribute memory 4 at the position corresponding to that of the picture screen memory 5.

That is, in the case where the attribute indication infomation represents monochromatic display, "0" is stored in the character attribute memory 4, while, on the contrary in the case where the information represents color display, "1" is stored.

Further, the dot pattern data for monochromatic display is stored in the dot pattern memory 6.

The display character codes stored in the picture screen memory 5 are successively read out in the order of display in synchronism with raster scanning on the picture screen of the CRT 19 under the control of the address circuit 14. Dot signals to be displayed on a present raster of a dot pattern of display characters are serially produced from the dot pattern memory 6 in accordance with the codes of the display characters and in response to a raster signal produced from the address circuit 14.

Character attributes are read out of the character attribute memory 4 by the address circuit 14 in synchronism with reading-out of the display character codes from the picture screen memory 5. In this case, the specific bit of each of the read-out character attributes is "0", so that the flip-flop 15 is held in the reset state and the color/monochrome change-over signal 13 is maintained at "0". Therefore, the monochromatic display circuit 8 is placed in its output-enabling state so as to transfer the dot signal applied thereto from the dot pattern memory 6 to the CRT 19 as the dot signal (Y) for monochromatic display. Since the flip-flop 15 is held in the reset state, on the other hand, an output of the color display circuit 7 is suppressed and the information signals R, G and B are not sent out.

FIGS. 2*a* and 2*b* are diagrams for explaining the relationship between dot pattern data in the dot pattern memory 6 and display thereof on the picture screen of the CRT 19 in the case of the monochromatic display. FIG. 2*a* shows the dot pattern data in the dot pattern memory 6. In a period for scanning a certain raster, a first series of the bits 31, that is, 001, 002, 003, 004, . . . are successively read out, and in the next period for scanning a succeeding raster, the next series of bits 31, that is, 011, 012, 013, 014, . . . are successively read out. Similarly, in the further period for scanning a further succeeding raster, 021, 022, 023, 024, . . . are read out, in the still further next period for scanning a still further succeeding raster, 031, 032, 033, 034, . . . are read out, and so on. Each bit 31 is displayed on the picture screeen of the CRT 19 as one dot, that is, one picture element of a monochromatic picture image 32. That is, as shown in FIG. 2*b*, the series of bits 31, that is, 001, 002, 003, 004, . . . are correspondingly displayed as the dots 001', 002', 003', 004' . . .

Next, description will be made as to the operation in the case of color display. In this case, dot pattern data for color display is stored in the dot pattern memory 6. Display character codes are stored in the picture screen memory 5 and corresponding character attributes each having a specific bit set at "1" are stored in the character attribute memory 4 at the positions corresponding to those in the picture screen memory 5. Reading-out operation from the character attribute memory 4, the picture screen memory 5 and the dot pattern memory 6 is performed in the same manner as in the case of monochrome display.

That is, the display character codes stored in the picture screen memory 5 are successively read out in the order of display in synchronism with raster scanning on the picture screen of the CRT 19 under the control of the address circuit 14. Dot signals to be displayed on a present raster of a dot pattern of display characters are serially produced from the dot pattern memory 6 in accordance with the codes of display characters and in response to a raster signal produced from the address circuit 14.

Character attributes are read out of the character attribute memory 4 with the help of the address circuit 14 in synchronism with reading-out of the display character codes from the picture screen memory 5. In this case, the specific bit of each of the read-out character attributes is "1", so that the flip-flop 15 is held in the set state and the color/monochrome change-over signal 13 is maintained at "1". Therefore, the color display circuit 7 is placed in its output-enabling state, and forms information signals R, G and B from the dot signals entered from the dot pattern memory 6, the thus formed signals R, G and B being transferred to the CRT 19 so as to be displayed thereon as a picture image with picture elements each constituted by four dots.

In this case, the specific bit of each of the characters attributes is "1", so that the flip-flop 15 is set and the color/monochrome change-over signal 13 becomes "1". Therefore, the output of the monochromatic display circuit 8 is suppressed.

FIGS. 3*a* and 3*b* are diagrams for explaining the relationship between dot pattern data in the dot pattern memory 6 and display thereof on the picture screen of the CRT 19 in the case of color display. FIG. 3*a* shows the dot pattern data 42 in the dot pattern memory 6. In a period for scanning a certain raster, a series of bits 41, that is, 001(R), 002(B), 013(G), 014(B), . . . are successively read out, and in the next period for scanning a succeeding raster, the next series of bits 41, that is, 003(G), 004(B), 011(R), 012(B), . . . are successively read out. Applying the same rule, in the further period for scanning a further succeeding raster, 101(R), 102(B), . . . are read out, in the still futher period for scanning a still further succeeding raster, 103(R), 104(B) . . . are read out, and so on.

Here, the bits (R), (G) and (B) represents red, green and blue information respectively.

In FIG. 3*b*, a reference numeral 43 represents a dot on the picture screen of the CRT 9. Each picture element 33 of the color picture image is constituted by four dots 43. All the four dots 43 constituting each color picture element 44 are displayed with the same colors in the prior art case as described above, however, in the case of the embodiment according to the present invention, every two of the four dots 43 constituting each color picture element are displayed with the same colors to thereby determine the display color of the whole picture element.

Description will be made as to the relationship between a set of four dots 42, that is, 001(R), 002(B), 003(G), and 004(B) and a picture element 44 corresponding to the set 42, hereunder. The respective colors of two dots (in the drawing, the dots represented by 001'(R) and 002'(B)) among the four dots constituting the picture element 44 are designated by the two bits of 001(R) and 002(R), and the respective colors of the remainder two dots (in the drawing, the dots represented by 003'(G) and 004'(B)) are designated by the two bits of 003(G) and 004(B). That is, the color display circuit 7 forms the information signals R, G and B so as to perform display in such a manner as described above.

In this embodiment according to the present invention, in the case where interlaced scanning is performed in the CRT 19, there occurs a case where one side display is performed only by the even or odd rasters to thereby cause flickers. In order to prevent these flickers of the picture screen from occurring, as shown in FIG. 3(*b*), zigzag display is effected such that the order of the color designation is inverted every picture element, and the dot pattern data is formed such that color display is performed with no flicker on the even and odd rasters. The dot pattern data for picture elements are formed such that, for example, a first picture element of 001'(R), 002'(B), 003'(G), and 004'(B) is followed by a second or succeeding picture element of 013'(G), 014'(B), 011'(R), and 012'(B). Thus, the set of dots of (R) and (B), and the set of dots (G) and (B) are alternately displayed on the even and odd rasters, respectively.

Figure 4:
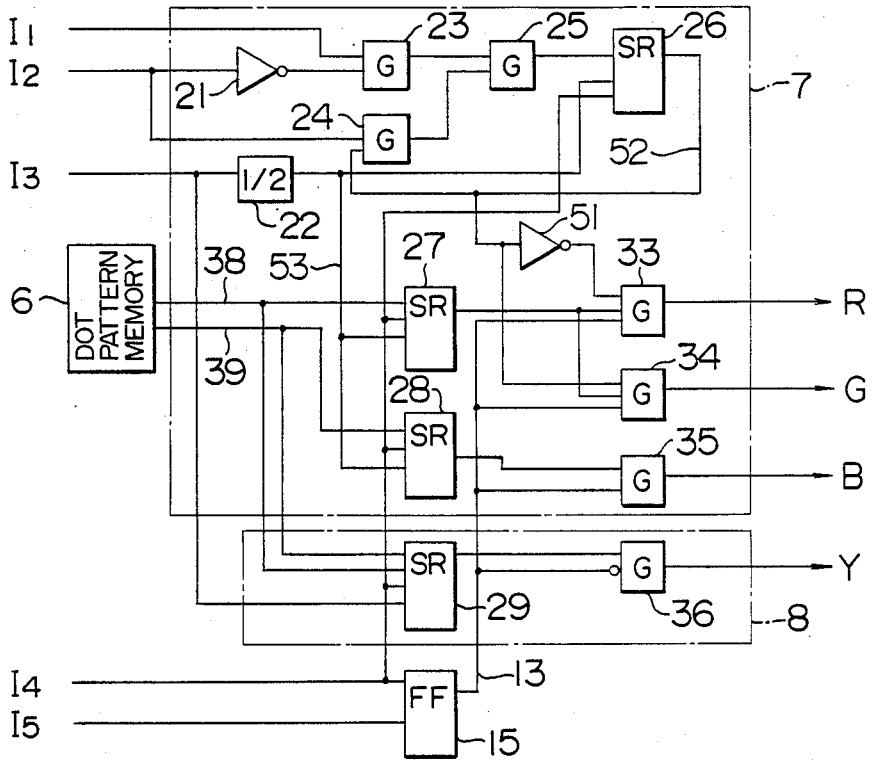
FIG. 4 is a block diagram showing a color and a monochromatic display circuit in detail.
Figure 5:
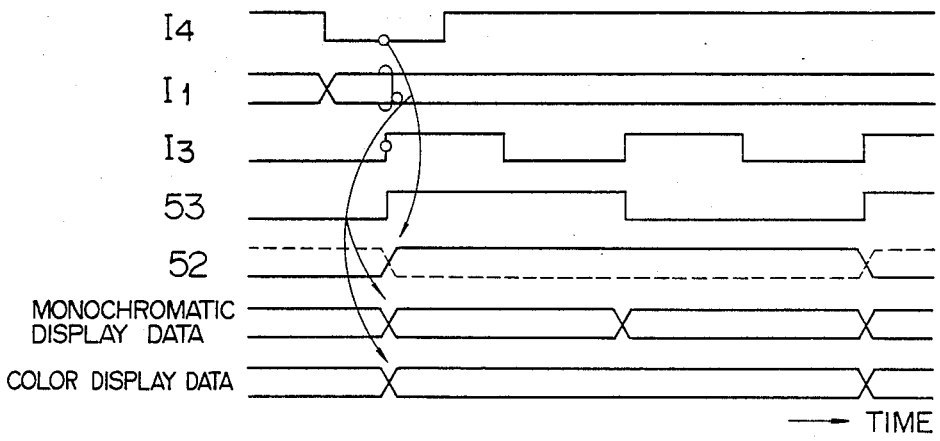
FIG. 5 is a time chart showing signals related to the color and monochromatic display circuits.

FIG. 4 is a block diagram showing the color and monochromatic display circuits 7 and 8 in detail. FIG. 5 is a time chart of the signals related to the color and monochromatic display circuits 7 and 8.

First, description will be made as to the color display circuit 7. Respective even and odd dot pattern bit data are separately produced from the dot pattern memory 6 as dot signals 38 and 39 which are loaded into shift registers 27 and 28 respectively. The timing of the loading is given by a synchronizing signal $I_4$ from the address circuit 14. The synchronizing signal $I_4$ is used for loading the dot signals 38 and 39 for every character and the period thereof is determined in accordance with the number of bits of the dot signals 38 or 39 per character. The data accumulated in the shift registers 27 and 28 are respectively serially produced as the color information signals R, G and B through AND gates 33, 34 and 35, in accordance with a shift timing 53 obtained by dividing the frequency of a fundamental timing $I_3$ which is the timing for sending out dot data to the CRT 19, by using a ½ frequency-divider circuit 22 to have a period twice as long as that of the fundamental timing $I_3$. The output of the shift register 27 is applied to the gates 33 and 34, while the output of the shift register 28 is applied to the gate 35. Also a display control signal 52 and the color/monochrome change-over signal 13 are applied to the gate 34, and also a signal obtained by inverting the display control signal 52 by an inverter 51 and the color/monochrome change-over signal 13 are applied to the gate 33. The display control signal 52 and the inverted signal thereof control the gates 34 and 33 respectively such that the display color of the head dot on the even raster is made to be red (R) and the display color of the head dot of the odd raster is made to be blue (B). In each raster, the gates 33 and 34 are alternately opened and closed with a period of the timing 53 to alternately display the red (R) and the green (R). The gate 35 is controlled only by the color/monochrome change-over sinal 13.

That is, the gates 33 and 34 are used for changing the display color of the head dot on the odd and even rasters respectively, and for changing-over the display color between the R and G for every two dots in each raster.

Thus, in the case where the color/monochrome change-over signal 13 is "1", the information signals R, G and B for color display as described with reference to FIG. 3*b* are sent out from the gates 33, 34 and 35, respectively, so that a color picture image is displayed on the picture screen of the CRT 19.

Mixed colors of R, G and B can be displayed by disposing R, G and B close to each other, other than the colors RB and GB.

The display control signal 52 is formed in a circuit constituted by an inverter 21, AND gates 23, 24 and 25 and a shift register 26 on the basis of the synchronizing signal $I_4$, a $2^0$ bit signal $I_1$ representing the odd raster, a signal $I_2$ representing a display period of one raster (both the signals $I_1$ and $I_2$ being applied to the circuit from the address circuit 14), and the timing 53. The display control signal 52 controls the display color such that the display color is made to be R in the even raster, while it is made to be G in the odd raster.

The flip-flop 15 latches the state of signal $I_5$ of the specific bit of the character attribute produced from the character attribute memory 4 in accordance with the timing of the synchronizing signal $I_4$. The respective reading-out operations from the dot pattern memory 6 and the character attribute memory 4 are synchronized with each other by the synchronizing signal $I_5$ for every character. That is, a dot pattern of a certain character is read out and an attribute of the character is read out and produced during reading-out of a dot pattern of a succeeding character.

Next, description will be made as to the monochromatic display circuit 8. The dot signals 38 and 39 are loaded into a shift register 29 in accordance with the synchronizing signal $I_4$. The loaded data is serially sent-out to a gate 36 in synchronism with the fundamental timing $I_3$. The gate 36 is controlled only by the color/-monochrome change-over signal 13. The color/monochrome change-over signal 13 which is now "0" is inverted into "1" at an input terminal of the gate 36 so that the gate 36 is enabled to send out a signal applied thereto from the shift register 29 as the monochromatic display dot signal (Y). Thus, the monochromatic display as described in FIG. 2*a* is performed. As shown in FIG. 5, since color designation in the case of color display is darker than in the case of monochromatic display, time taken for display is made longer so as to produce the signals R and B at the same time.

As described above, according to the embodiment of the present invention, it is possible to display a color picture image by using the same memory capacity as that for a monochromatic picture image. Moreover, differing from the conventional method, the memory is not divided into sections and the control of the memory reading-out operation is changed-over between the color and monochromatic display modes in accordance with the designation of the character attribute, so that in the case of color display, the memory reading-out control is performed in the same manner as in the case of monochromatic display. Accordingly, a logic related to the memory read-out operation is not made complicated in comparison with the conventional method in which the memory division is performed.

In the embodiment according to the present invention, every picture element of the color picture image is constituted by four dots on the picture screen, and four bit data, that is, R, G, B and Y is stored as the color designation information for each picture element in the dot pattern memory 6. The present invention, however, is not limited to this. Generally, every pictue element is constituted by N dots and data of N bits per picture element may be stored in the dot pattern memory 6.

The luminance signal and the G signal are selectively taken out through a single line in the embodiment as described above, but the luminance signal may be taken out through a separately provided signal line. Further, the color information to be displayed is entered through the keyboard 18 in the embodiment according to the present invention, however, data produced from an upper rank system such as a host computer or the like may be used as the color information.

Further, it is a matter of course that various changes in arrangement can be made in the embodiment as described above, without departing from the subject and spirit of the present invention.

As described above, according to the present invention, the following effects are obtained:

(1) It is possible to display a color picture image by using a memory of the same capacity as that required in the case of monochromatic picture image;

(2) The memory is not divided into sections and the memory read-out control in the case of color display is performed in the same manner as in the case of monochromatic display, so that the memory peripheral logic can be simplified; and (3) The memory is not divided into sections so that a highly densely integrated memory can be used when used in a device having a screen constituted by numbers picture elements, and it is possible to decrease in cost of the memory.

I claim:

1. A display apparatus provided with an input means for indicating codes for data to be displayed on a picture screen, comprising:

(a) first memory means for storing said code indicated by said input means at positions in said first memeory means corresponding to the respective display positions of the data displayed on said picture screen, and from which said written-in code is read-out in synchronism with raster scanning on said picture screen;

(b) second memory means for storing in a single memory plane dot pattern data corrsponding to the data indicated by said codes stored in said first memeory means, said dot pattern data being stored in successive lines of storage locations in said single memory plane such that, for monochromtic disply data each picture element is stored in a respective storage location corresponding to one dot on said picture screen, and for color display data N color information signals are regularly stored in a predetermined pattern in N adjacent storage locations of said single memory plane for each picture element corresponding to N dots on said picture screen;

(c) third memory means for storing information indicating an attribute of said codes stored in said first memory means;

(d) control means for indicating whether monochromatic display or color display is to be performed with respect to said dot pattern data stored in said second memory means on the basis of said attribute information stored in said third memory means; and (e) display means for performing said monochromatic display or said color display with respect to said dot pattern data stored in said second memory means, on the basis of the output of said control means, and including a monochromatic display circuit connected to said second memory means and including means for reading said dot pattern data from said second memory means such that each picture element in said second memory means defines one dot in said monochromatic display, and a color display circuit connected to said second memory means and including means for reading said dot pattern data from said second memory means such that one picture element of said second memory means defines N dots in said color display and in which said color display circuit reads each scanline of said second memory means such that, in combination with said predetermined pattern, color information corresponding to at least one color is applied to one display raster field and other colors are applied alternately along a corresponding scanline in at least another display raster field.

2. A display apparatus according to claim 1, in which said judgement means reads out said character attribute stored in said third memory means corresponding to said code stored in said first memory means in synchronism with reading-out of said first memory means, thereby changing-over between said monochromatic display circuit and said color display circuit in accordance with said character attribute.

3. A display apparatus provided with an input means for indicating codes for data to be displayed on a picture screen, comprising:

(a) first memory means for storing said codes indicated by said input means at positions in said first memory means corresponding to the respective display positions of the data displayed on said picture screen, and from which said written-in code is read-out in synchronism with raster scanning on said picture screen;

(b) second memory means for storing in a single memory plane dot pattern data corresponding to the data indicated by said codes stored in said first memory means, said dot pattern data being stored in successive lines of storage locations in said single memory plane such that, for monochromatic display data each picture element is stored in a respective storage location corresponding to one dot on said picture screen, and for color display data N color information signals are regularly stored in a predetermined pattern in N adjacent storage locations of said single memory plane for each picture element corresponding to N dots on said picture screen, and the positional sequence of said color information signals within said predetermined patten is alternated for each picture element along a corresponding line of said single memory plane;

(c) third memory means for storing information indicating an attribute of said codes stored in said first memory means;

(d) control means for indicating whether monochromatic display or color display is to be performed with respect to said dot pattern data stored in said second memory means on the basis of said attribute information stored in said third memory means; and (e) display means for performing said monochromatic display or said color disply with respect to said dot pattern data stored in said second memory means, on the basis of the output of said control means, and including a monochromatic display circuit connected to said second memory means and including means for reading said dot pattern data from said second memory means such that each picture element in said second memory means defines one dot in said monochromatic display, and a color display circuit connected to said second memory means and including means for reading said dot pattern data from said second memory means such that one picture element is constituted by N dots in said color display.

4. A display apparatus according to claim 3 in which said judgement means reads out said character attribute stored in said third memory corresponding to said code stored in said first memory in synchronism with reading-out of said first memory, thereby changing-over between said monochromatic display-circuit and said color display circuit in accordance with said character attribute.

5. A method of display provided with an input means for indicating codes for data to be displayed on a picture screen, comprising:

(a) a first step of writing said codes indicated by said input means into a first memory at positions in said first memory corresponding to the display positions of data displayed on said picture screen, and reading said written-in code out of said first memory in synchronism with raster scanning on said picture screen;

(b) a second step of storing dot pattern data corresponding to said coded stored in said first memory into a single memory plane of a second memory, said dot pattern data being stored in successive lines of storage locations in said single memory plane such that, for monochromatic display data each picture element is stored in a respective storage location corresponding to one dot on said picture screen, and for color display data N color information signals are regularly stored in a predetermined pattern in N adjacent storage locations of said single memory plane for each picture element corresponding to N dots on said picture screen;

(c) a third step of storing information for applying an attribute of said codes stored in said first memory into a third memory;

(d) a fourth step of indicating whether a monochromatic display or a color display is to be performed with respect to said dot pattern data stored in said second memory on the basis of said attribute information stored in said third memory; and (e) a fifth step of performing said monochromatic display or said color display with respect to said dot pattern data stored in said second memory, on the basis of the indication produced in said fourth step, and including displaying the dot pattern data so that one picture element defines one dot in said monochromatic display, while one picture element defines N dots in said color display and in which said color display circuit reads each scanline of said second memory means such that, in combination with said predetermined pattern, color informaiton corresponding to at least one color is applied to one display raster field and other colors are applied alternately along a corresponding scanline in at least another display raster field.

6. A display apparatus according to claim 5, in which in said fourth step said character attribute stored is said third memory corresponding to said code stored in said first memory is read out in synchronism with reading-out of said first memory, thereby changing-over between said monochromatic display and said color display in accordance with said character attribute.

7. A method of display provided with an input means for indicating codes for data to be displayed on a picture screen, comprising:

(a) a first step of writing said code indicated by said input means into a first memory at positions in said first memory corresponding to the display positions of data displayed on said picture screen, and reading said written-in code out of said first memory in synchronism with raster scanning on said picture screen;

(b) a second step of storing dot pattern data corresponding to said code stored in said first memory into a single memory plane of a second memory, said dot pattern data being stored in successive lines of storage locations in said single memory plane such that, for monochromatic display data each picture element is stored in a respective storage location corresponding to one dot on said picture screen, and for color display data N color information signals are regularly stored in a predetermined pattern in N adjacent storage locations of said single memory plane for each picture element corresponding to N dots on said picture screen, and the positional sequence of said color information signals within said predetermined pattern is alternated for each picture element along a corresponding line of said single memory plane;

(c) a third step of storing information for applying an attribute to said code stored in said first memory into a third memory;

(d) a fourth step of indicating whether a monchromatic display or a color display is to be performed with respect to said dot pattern data stored in said second memory on the basis of said attribute information stored in said third memory; and (e) a fifth step of performing said monochromatic display or said color display with respect to said dot pattern data stored in said second memory, on the basis of the indication produced in said fourth step, and including displaying the dot pattern data so that one picture element defines one dot in said monochromatic display, while one picture element defines N dots in said color display.

8. A display apparatus according to claim 7, in which in said fourth step said character attribute stored is said third memory corresponding to said code stored in said first memory is read out in synchronism with reading-out of said first memory, thereby changing-over between said monochromatic display and said color display in accordance with said character attribute.

* * * * *